US007574874B2

(12) United States Patent
Aflekt et al.

(10) Patent No.: US 7,574,874 B2
(45) Date of Patent: Aug. 18, 2009

(54) VAPOR COMPRESSION HEAT PUMP SYSTEM

(75) Inventors: Kåre Aflekt, Trondheim (NO); Armin Hafner, Tronheim (NO); Arne Jakobsen, Trondheim (NO); Petter Nekså, Trondheim (NO); Jostein Pettersen, Trondheim (NO); Håvard Rekstad, Trondheim (NO); Geir Skaugen, Trondheim (NO); Trond Andresen, Trondheim (NO); Espen Tøndell, Trondheim (NO); Munan Elgæther, Trondheim (NO)

(73) Assignee: Sinvent AS, Trondheim (NO)

( * ) Notice: Subject to any disclaimer, the term of this patent is extended or adjusted under 35 U.S.C. 154(b) by 456 days.

(21) Appl. No.: 10/540,202

(22) PCT Filed: Dec. 17, 2003

(86) PCT No.: PCT/NO03/00424

§ 371 (c)(1),
(2), (4) Date: Feb. 14, 2006

(87) PCT Pub. No.: WO2004/057245

PCT Pub. Date: Jul. 8, 2004

(65) Prior Publication Data

US 2006/0137387 A1 Jun. 29, 2006

(30) Foreign Application Priority Data

Dec. 23, 2002 (NO) ..... 20026233

(51) Int. Cl.
*F25B 41/00* (2006.01)

(52) U.S. Cl. ..... 62/513; 62/197

(58) Field of Classification Search ..... 62/513, 62/114, 225, 194.4, 197
See application file for complete search history.

(56) References Cited

U.S. PATENT DOCUMENTS 6,260,367 B1 * 7/2001 Furuya et al. ..... 62/197
2001/0052238 A1 * 12/2001 Burk et al. ..... 62/323.1

FOREIGN PATENT DOCUMENTS

EP 1043550 3/2004
JP 2001-235239 8/2001

* cited by examiner

*Primary Examiner*—Melvin Jones
(74) *Attorney, Agent, or Firm*—Wenderoth, Lind & Ponack, L.L.P.

(57) ABSTRACT

A compression refrigeration system that includes a compressor, a heat rejector, expansion means and a heat absorber connected in a closed circulation circuit that may operate with supercritical high-side pressure.

14 Claims, 3 Drawing Sheets

VAPOR COMPRESSION HEAT PUMP SYSTEM

FIELD OF INVENTION

The present invention relates to a method for the operation of a compression refrigeration system including a compressor, a heat rejector, an expansion unit and a heat absorber connected in a closed circulation circuit that may operate with supercritical high-side pressure, using carbon dioxide or a mixture containing carbon dioxide as the refrigerant in the system.

BACKGROUND OF THE INVENTION

Conventional vapor compression systems reject heat by condensation of the refrigerant at subcritical pressure given by the saturation pressure at the given temperature. When using a refrigerant with low critical temperature, for instance $CO_2$, the pressure at heat rejection will be supercritical if the temperature of the heat sink is high, for instance higher than the critical temperature of the refrigerant, in order to obtain efficient operation of the system. The cycle of operation will then be transcritical, for instance as known from WO 90/07683.

WO 94/14016 and WO 97/27437 both describe a simple circuit for realizing such a system, in basis comprising a compressor, a heat rejector, an expansion means and an evaporator connected in a closed circuit. $CO_2$ is the preferred refrigerant for these systems.

EP-A-10 043 550 relates to a compression refrigeration system using $CO_2$ where an attempt is made to improve the heat pump efficiency of the system by controlling the compressor suction gas superheat.

Heat rejection at super critical pressures will lead to a refrigerant temperature glide. This can be applied to make efficient hot water supply systems, e.g. known from U.S. Pat. No. 6,370,896 B1.

Ambient air is a cheap heat source which is available almost everywhere. Using ambient air as a heat source, vapor compression systems often have a simple design which is cost efficient. However, at high ambient temperatures, the exit temperature of the compressor may become low, for instance around 70° C. for a trans-critical $CO_2$ cycle. The desired temperature of tap water is often 60-90° C. The exit temperature of the compressor can be increased by increasing the exit pressure, but it will lead to a system performance drop. Another drawback with increasing pressure is that components will be more costly due to higher design pressures.

Another drawback occurring at high ambient temperatures is that superheating the compressor suction gas, which normally is provided by an internal heat exchanger (IHX), is not possible, as long as evaporation temperature is higher than the heat rejector refrigerant outlet temperature. Hence, there is a risk of liquid entering the compressor.

A strategy to solve these problems is to regulate the evaporation temperature such that it is below the heat rejector refrigerant outlet temperature. This will make superheating the suction gas possible and also increase the compressor discharge temperature for better hot water production; however, the system energy efficiency will be poor since suction pressure will be lower than necessary.

U.S. Pat. No. 6,370,896 B1 presents a solution to these problems, by using a part of the heat rejector to heat the compressor suction gas. The full flow on the high pressure side is heat exchanged with the full flow on the low pressure side. This will ensure superheating of compressor suction gas, and thereby secure safe compressor operation; however, the system efficiency drops compared to a system which compresses saturated gas (if possible) and which operates with a higher exit pressure to achieve a sufficient compressor discharge temperature.

SUMMARY OF THE INVENTION

An object of the present invention is to make a simple, efficient system that avoids the aforementioned shortcomings and disadvantages.

The present invention relates to a compression refrigeration system, comprising at least a compressor, a heat rejector, an expansion unit and a heat absorber. By superheating the compressor suction gas temperature, the compressor exit temperature can be increased without increasing the exit pressure and hot water at desired temperatures can be produced. By using a split flow (or flow splitting arrangement) at an appropriate temperature from the heat rejector, it is possible to superheat the compressor suction gas, for instance using a counterflow heat exchanger. After heating the compressor suction gas, the split flow is expanded directly to the low pressure side of the system. In this way, the two parts of the heat rejector will have different heating capacity per kilogram water flow due to a lower flow in the latter part. It is hence possible to adapt a water heating temperature profile even closer to the refrigerant cooling temperature profile. Hot water can be produced with a lower high side pressure, and hence with a higher system efficiency.

BRIEF DESCRIPTION OF THE DRAWINGS

The invention will be further described in the following by way of examples only and with reference to the drawings in which.

DETAILED DESCRIPTION OF THE INVENTION

Figure 1:
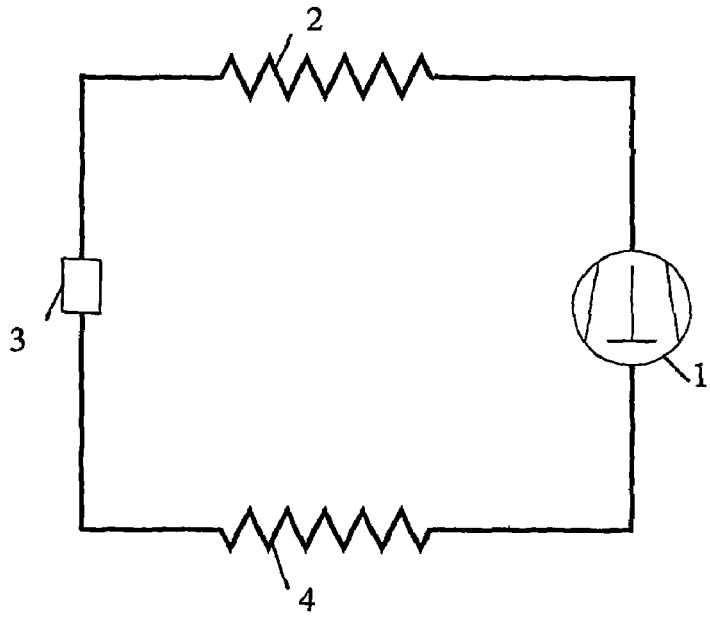
FIG. 1 illustrates a simple circuit for a vapor compression system.

FIG. 1 illustrates a conventional vapor compression system comprising a compressor 1, a heat rejector 2, an expansion means 3 and a heat absorber 4 connected in a closed circulation system. When using, for instance $CO_2$ as refrigerant, the high-side pressure will normally be supercritical in hot water supply systems in order to achieve efficient hot water generation in the heat rejector, as illustrated by circuit A in FIG. 2. Desired tap water temperatures are often 60-90° C., and the refrigerant inlet temperature to the heat rejector 2, which is equal or lower than the compressor discharge temperature, has to be above the desired hot water temperature.

Ambient air is often a favorable alternative as a heat source for heat pumps. Air is available almost everywhere, it is inexpensive, and the heat absorber system can be made simply and cost efficiently. However, at increasing ambient temperatures, the evaporation temperature will increase and the compressor discharge temperature will drop if the compressor discharge pressure is constant, see circuit B in FIG. 2. In some instances, the compressor discharge temperature may drop below desired tap water temperature. Tap water production at a desired temperature will then be impossible without help from other heat sources.

Figure 2:
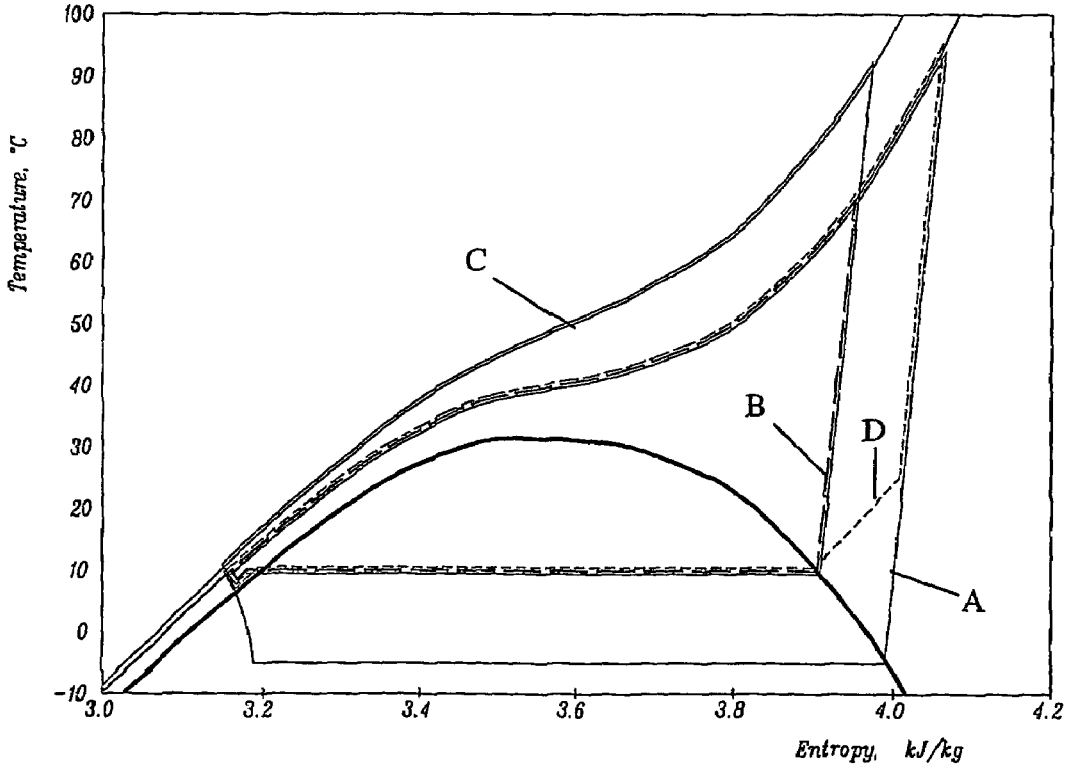
FIG. 2 shows a temperature entropy diagram for carbon dioxide with examples of operational cycles for hot water production.

One way to increase discharge temperature is to increase high side pressure, see circuit C in FIG. 2. But this will cause a reduction of system efficiency.

Figure 3:
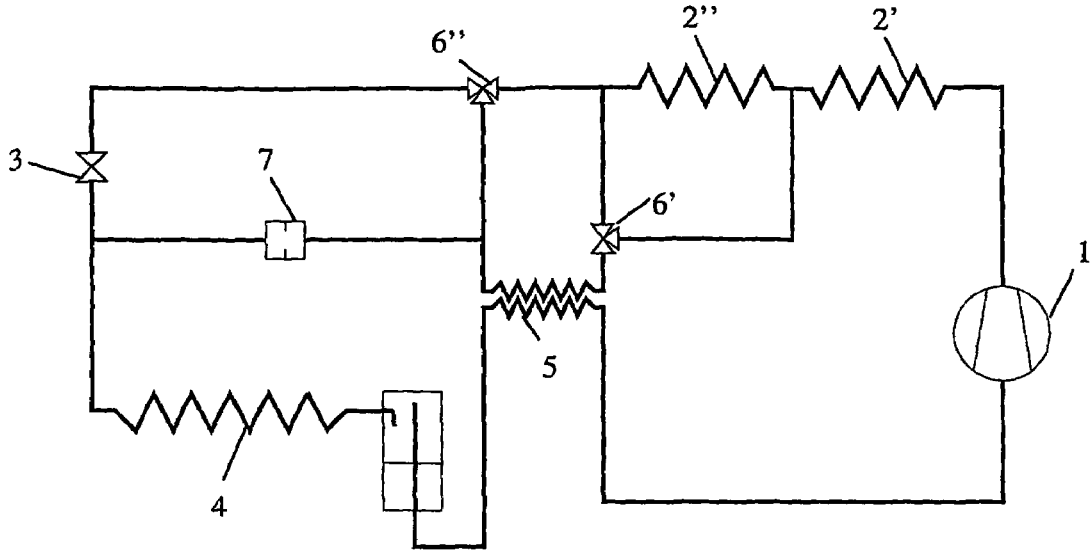
FIG. 3 is a schematic diagram showing an example of a modified cycle to improve system performance and operating range.

One way to superheat the suction gas is to use an Internal Heat Exchanger (IHX) 5, see FIG. 3. But for instance when heating tap water, the refrigerant is cooled down close to net water temperature, typically around 10° C., in the heat rejector (2). If the evaporation temperature is above this temperature, the suction gas will be cooled down instead of superheated, see FIG. 2. Liquid would then enter the compressor 1, causing severe problems. It is important to avoid using the IHX 5 when the evaporation temperature is equal or higher than the net water temperature.

The present invention will secure a suction gas superheat irrespective of ambient temperature. When the evaporation temperature, or other appropriate temperatures, reaches a predetermined level, a split stream from the heat rejector 2 at a suitable temperature, is carried to a heat exchanger, for instance a counterflow heat exchanger, for compressor suction gas heating. The compressor discharge temperature will increase, and hot water may be produced at high system efficiency, see circuit D in FIG. 2. After heating the compressor suction gas, the spilt stream is expanded directly down to the low pressure side.

EXAMPLE 1

One embodiment of the invention includes leading the split stream (e.g., through a stream splitting arrangement) through an already existing IHX 5. An arrangement for bypassing the main stream outside the IHX 5, and leading the split stream through the IHX 5, then has to be implemented. There are various configurations for this embodiment. One alternative is to use two three-way valves 6' and 6", as indicated in FIG. 3. One or both of three-way valves may for instance be replaced by two stop valves. The split stream is expanded directly to the low pressure side through an orifice 7 downstream of the IHX 5. The orifice 7 may be replaced by other expansion means, and valves may be installed upstream and/or downstream of the expansion unit for closer flow control through the expansion unit 7.

EXAMPLE 2

Figure 4:
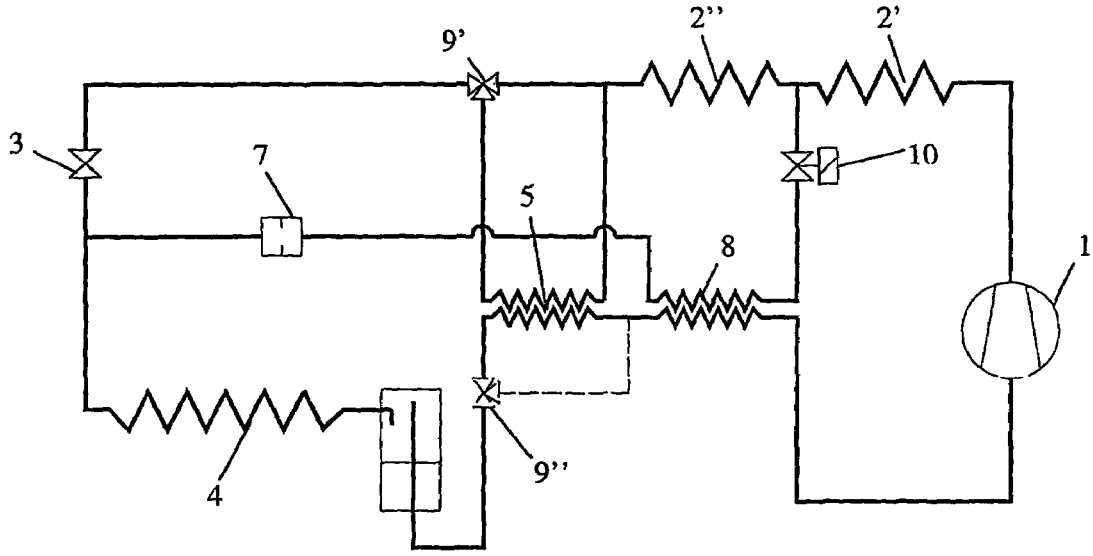
FIG. 4 a schematic diagram showing another example of a modified cycle to improve system performance and operating range.

Another embodiment includes installing a separate heat exchanger 8, for instance a counterflow heat exchanger, for suction gas heating. This is illustrated in FIG. 4. When the evaporation temperature, or other usable temperatures, reaches a predetermined level, a split stream (i.e., a stream splitting arrangement) is carried through the suction gas heater 8 (e.g., through a stream splitting arrangement) by opening the valve 10. This valve may be installed anywhere on the split stream line. The split stream is expanded directly to the low pressure side through an expansion means, for instance an orifice 7 as indicated in FIG. 4. The IHX 5 can be avoided either by an arrangement on the high pressure side indicated be the three way valve 9', or a equivalent arrangement on the low pressure side as indicated by dotted lines in FIG. 4.

Suction gas superheat may be controlled by regulation of the spilt stream flow. This can for instance be performed by a metering valve in the split stream line. Another option is to apply a thermal expansion valve.

Figure 5:
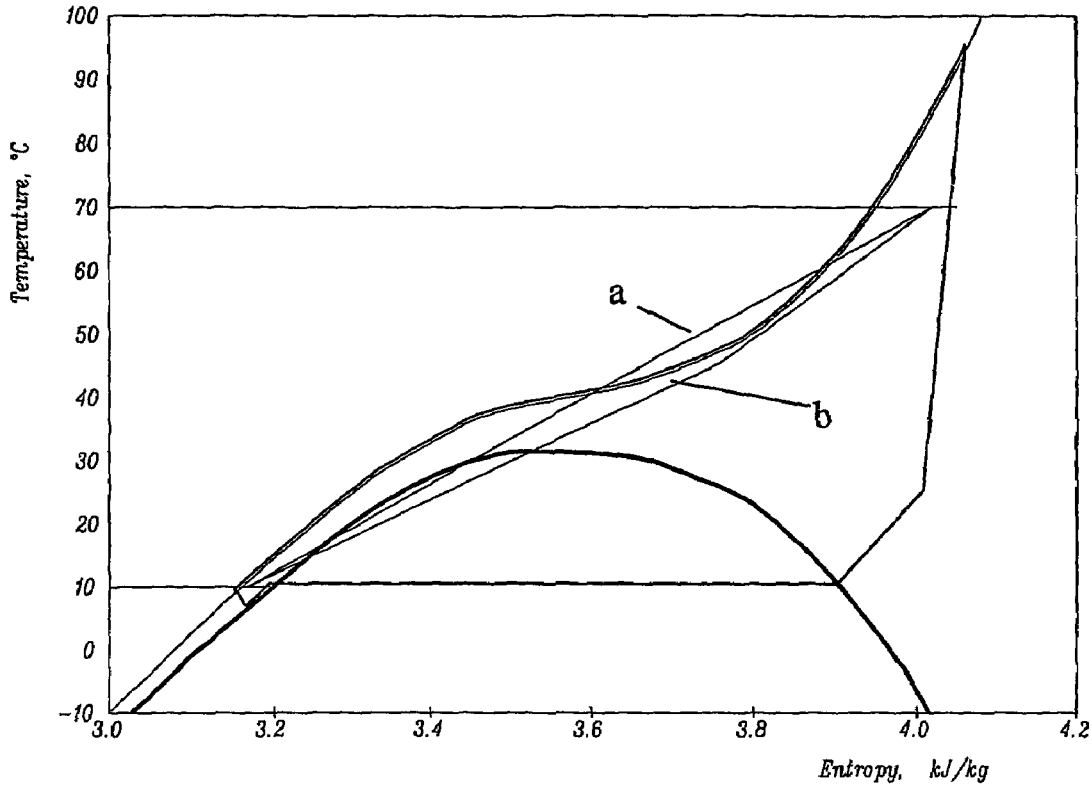
FIG. 5 shows a temperature entropy diagram for carbon dioxide with examples of temperature profiles for the heat rejector.

As explained above, the invention will improve the energy efficiency at high heat source temperatures, indicated by circuit D in FIG. 2. By applying embodiments of the present invention the high side pressure may be further reduced compared to conventional systems optimum pressure. This is illustrated in FIG. 5. The first part of the heat rejector 2' will have a higher heating capacity relative to the water flow, compared to the latter part of the heat rejector 2". The temperature profile for the water heating will be even better adapted to the cooling profile of the refrigerant, see water heating profile b in FIG. 5. Applying a conventional system will lead to the water heating profile a. As can be seen from FIG. 5, a temperature pinch will occur in the heat rejector 2. High side pressure will then have to be increased. With the embodiments of the present invention, it is possible to produce hot water at desired temperature with a lower high side pressure, leading to an even more energy efficient system.

The invention claimed is:

1. A compression refrigeration system configured for use with a refrigerant containing carbon dioxide, the system comprising:

a compressor;

a heat rejector;

a first expansion unit;

a heat absorber; and a stream splitting arrangement extending from the heat rejector at a high pressure side thereof and including a second expansion unit;

wherein the compressor, the heat rejector, the first expansion unit, the heat absorber and the stream splitting arrangement are connected in a closed circulation circuit that is configured to operate with supercritical high-side pressure; and wherein the stream splitting arrangement is configured to generate a split stream flow to control superheating of compressor suction gas and further configured to expand the split stream flow from the high pressure side of the heat rejector through the second expansion unit directly to a low pressure side of the heat absorber after heating the compressor suction gas.

2. A system according to claim 1, further comprising:

a heat source operably connected to the compression refrigeration system; and wherein the stream splitting arrangement is configured to increase the temperature of the compressor suction gas when the temperature of the heat source is above a predetermined level.

3. A system according to claim 1, wherein the stream splitting arrangement is configured to control superheating of the compressor suction gas, such that it has a temperature that is equal to a discharge temperature of the compressor.

4. A system according to claim 1, wherein the stream splitting arrangement includes a metering valve configured to regulate the split stream flow to control the superheating of the compressor suction gas.

5. A system according to claim 1, wherein the stream splitting arrangement includes a counterflow heat exchanger configured to heat the compressor suction gas.

6. A system according to claim 1, further comprising:

a first heat exchanger positioned on the high pressure side of the heat rejector.

7. A method for the operation of a compression refrigeration system including a closed circulation circuit configured to operate with supercritical high-side pressure, the closed circulation circuit having a compressor, a heat rejecter, a first expansion unit, and a heat absorber, the compression refrigeration system further including a stream splitting arrangement extending from the heat rejector at a high pressure side thereof directly to a low pressure side of the heat absorber, and including a second expansion unit, wherein the compression refrigeration system is configured for use with a refrigerant containing carbon dioxide, the method comprising:

generating a split stream flow through the stream splitting arrangement;

controlling superheating of compressor suction gas via the split stream flow; and expanding the split stream flow through the second expansion unit after heating the compressor suction gas.

8. A method according to claim 7, wherein said controlling of the superheating of the compressor suction gas includes increasing the temperature of the compressor suction gas when the temperature of a heat source is above a predetermined level.

9. A method according to claim 7, wherein said controlling of the superheating of the compressor suction gas includes controlling the superheating of the compressor suction gas to a temperature that is equal to a discharge temperature of the compressor.

10. A method according to claim 7, wherein said controlling of the superheating of the compressor suction gas includes regulating the split stream flow.

11. A method according to claim 7, wherein said controlling of the superheating of the compressor suction gas includes controlling the superheating of the compressor suction gas via a counterflow heat exchanger.

12. A method according to claim 7, wherein said controlling of the superheating of the compressor suction gas includes controlling the superheating of the compressor suction gas via a heat exchanger positioned on the high pressure side of the heat rejector.

13. A system according to claim 6, further comprising:

a second heat exchanger positioned in the stream splitting arrangement.

14. A system according to claim 6, wherein said first heat exchanger is positioned in the stream splitting arrangement.

* * * * *